US012693024B2

(12) United States Patent
Bierbaum et al.

(10) Patent No.: US 12,693,024 B2
(45) Date of Patent: Jul. 28, 2026

(54) REMOVABLE BRACKET ASSEMBLY FOR AN OVEN APPLIANCE MANIFOLD

(71) Applicant: Haier US Appliance Solutions, Inc., Wilmington, DE (US)

(72) Inventors: Charles Andrew Bierbaum, Louisville, KY (US); Gary Bundy, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 768 days.

(21) Appl. No.: 18/095,763

(22) Filed: Jan. 11, 2023

(65) Prior Publication Data

US 2024/0230106 A1 Jul. 11, 2024

(51) Int. Cl.
*F24C 15/10* (2006.01)
*F24C 3/12* (2006.01)

(52) U.S. Cl.
CPC ..... *F24C 15/10* (2013.01); *F24C 3/128* (2013.01)

(58) Field of Classification Search
CPC ..... F24C 15/10; F24C 3/128
USPC ..... 126/19 R
See application file for complete search history.

(56) References Cited

U.S. PATENT DOCUMENTS

| | | | | |
|---|---|---|---|---|
| 6,722,356 | B2 | 4/2004 | Distaso | |
| 7,299,799 | B2 | 11/2007 | Albizuri | |
| 7,490,628 | B2 | 2/2009 | Frost et al. | |
| 7,861,706 | B2 | 1/2011 | Bellomo | |
| 8,662,102 | B2 | 3/2014 | Shaffer et al. | |
| 9,103,553 | B2 * | 8/2015 | Daughtridge, Jr. | F24C 3/126 |
| 9,476,594 | B2 | 10/2016 | Fockler | |
| 9,976,749 | B2 | 5/2018 | Yang et al. | |
| 10,054,315 | B2 | 8/2018 | Choi | |
| 10,267,513 | B2 | 4/2019 | Huang et al. | |
| 10,401,035 | B2 | 9/2019 | Pionek et al. | |
| 10,677,470 | B2 | 6/2020 | Beghi et al. | |
| 11,175,038 | B2 | 11/2021 | Fox et al. | |
| 2011/0232626 | A1 * | 9/2011 | Kennedy | F24C 3/14 126/39 B |
| 2017/0314720 | A1 | 11/2017 | Iturbe Arriola | |

FOREIGN PATENT DOCUMENTS

| | | | |
|---|---|---|---|
| CN | 2849514 | Y * | 12/2006 |
| EP | 2341289 | B1 | 4/2017 |
| KR | 20200099472 | A | 8/2020 |
| WO | WO2001073326 | A1 | 10/2001 |

* cited by examiner

*Primary Examiner* — Allen R. B. Schult
*Assistant Examiner* — William C Weinert
(74) *Attorney, Agent, or Firm* — Dority & Manning, P.A.

(57) ABSTRACT

An oven appliance includes a cabinet defining a cooking chamber; a control panel provided on the cabinet; a fuel supply line provided at the cabinet; and a bracket. The bracket includes a first flange selectively coupled to the fuel supply line; a second flange extending from the first flange at a predetermined angle, the second flange being selectively coupled to the control panel; a vertical protrusion protruding from the first flange along the vertical direction toward the fuel supply line to locate the bracket with respect to the fuel supply line; and a horizontal locating protrusion protruding from the second flange away from the fuel supply line to locate the bracket with respect to the control panel.

16 Claims, 5 Drawing Sheets

REMOVABLE BRACKET ASSEMBLY FOR AN OVEN APPLIANCE MANIFOLD

FIELD OF THE INVENTION

The present subject matter relates generally to oven appliances, and more particularly to harness brackets for gas manifolds of oven appliances.

BACKGROUND OF THE INVENTION

Certain cooktop appliances can include a plurality of heating elements on a top panel. For instance, one or more gas burners may be provided on the top panel. Combustion of fuel at the gas burners heats pots, pans, griddles, etc. To regulate fuel flow to the gas burners, known gas burners are connected to a valve with a knob. A user turns the knob to regulate fuel flow to the associated gas burner. Accordingly, a switch harness may be provided at or near the knobs to assist or drive the fuel flow or power (e.g., fuel) supply to the burners.

Mounting and servicing valves and switches within such cooktop appliances can be problematic. For instance, an ignition switch of the valve can require servicing, and accessing the ignition switch in known cooktop appliances is difficult. A technician is generally required to remove the valve from a fuel manifold in order to access the ignition switch. This process is time consuming and can require specific tools. Moreover, a disconnection from a gas supply line may be required to properly access the switches required to be serviced, which may lead to potential damage to the gas line.

Accordingly, a bracket assembly that obviates one or more of the above-mentioned drawbacks would be beneficial. In particular, a bracket assembly providing easy access to control systems of a gas cooktop would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an oven appliance is provided. The oven appliance may include a cabinet defining a cooking chamber; a control panel provided on the cabinet; a fuel supply line provided at the cabinet; and a panel bracket. The panel bracket may include a first flange selectively coupled to the fuel supply line; a second flange extending from the first flange at a predetermined angle, the second flange being selectively coupled to the control panel; a vertical protrusion protruding from the first flange along the vertical direction toward the fuel supply line to locate the panel bracket with respect to the fuel supply line; and a horizontal protrusion protruding from the second flange away from the fuel supply line to locate the panel bracket with respect to the control panel.

In another exemplary aspect of the present disclosure, a control assembly for an oven appliance is provided. The oven appliance may include a control panel and a fuel supply line. The control assembly may include a panel bracket. The panel bracket may include a first flange; a second flange extending from the first flange at a predetermined angle; a vertical protrusion protruding from the first flange along the vertical direction toward the fuel supply line to locate the panel bracket with respect to the fuel supply line; and a horizontal protrusion protruding from the second flange away from the fuel supply line to locate the panel bracket with respect to the control panel. The control assembly may further include a manifold bracket, the manifold bracket being fixed to the fuel supply line. The panel bracket may be removably coupled to the manifold bracket.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
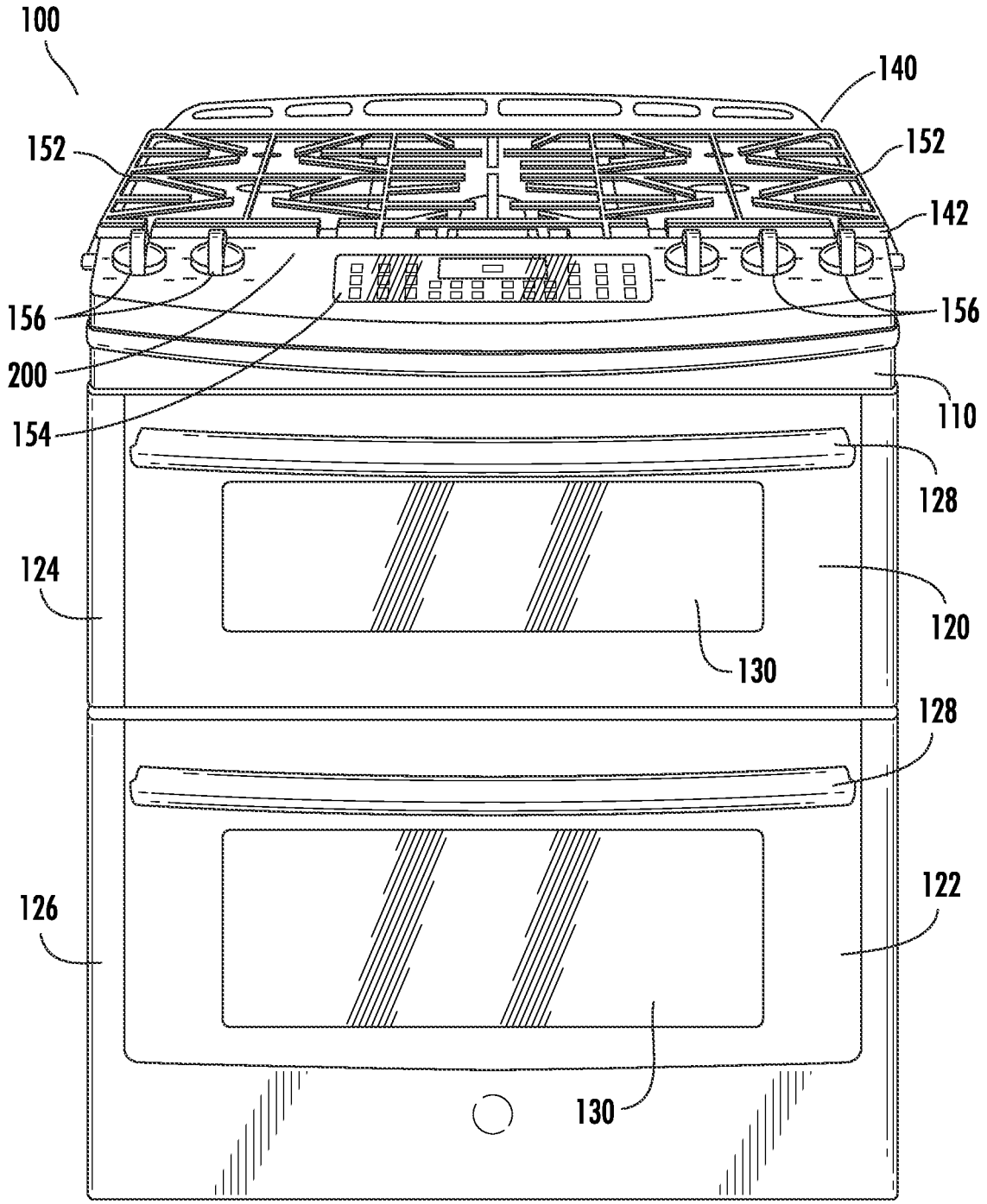
FIG. 1 provides a front, perspective view of an oven appliance according to an example embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
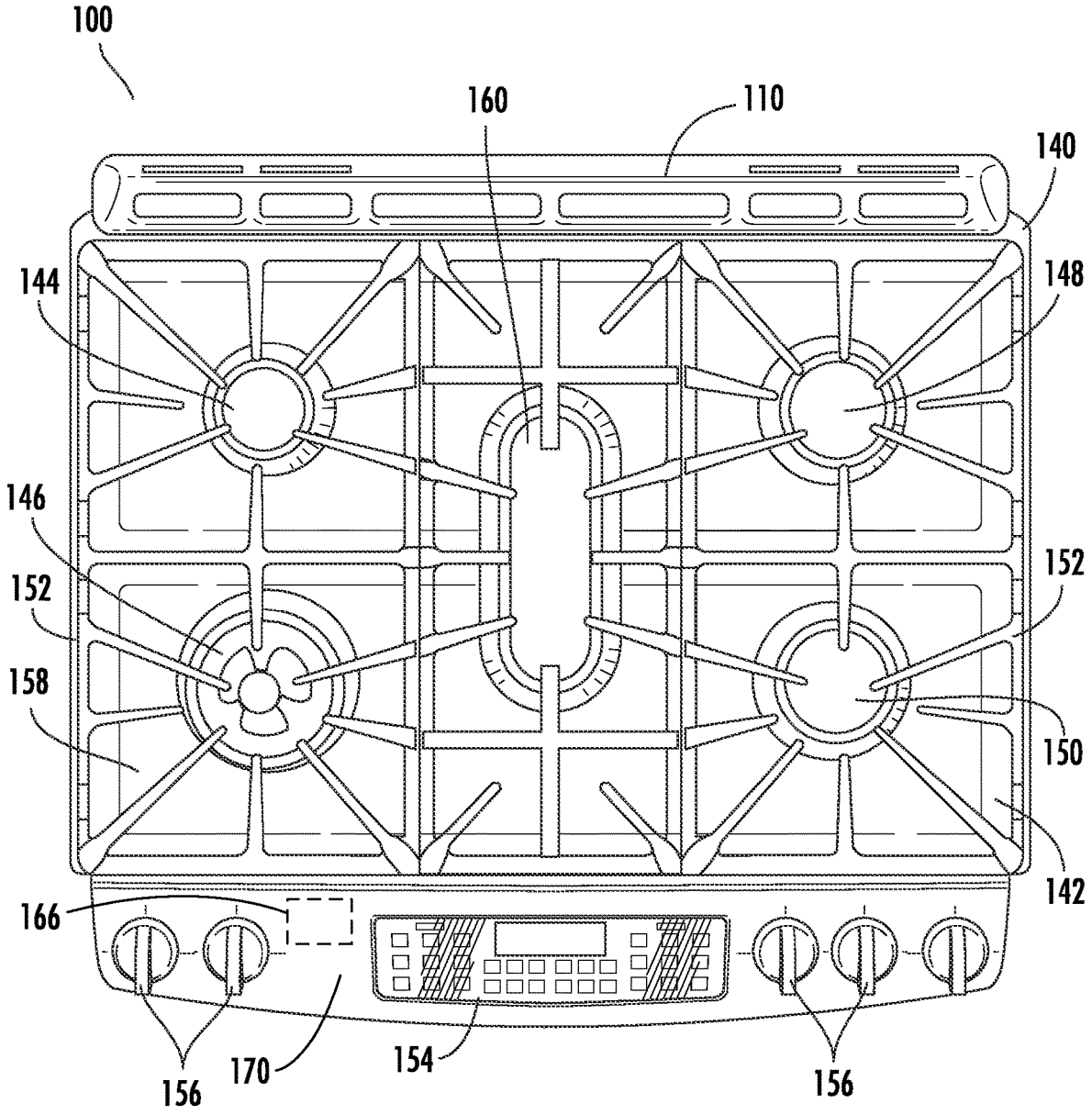
FIG. 2 provides a top, plan view of the example oven appliance of FIG. 1.

FIG. 1 is a front, perspective view of a range appliance (or oven appliance) 100 as may be employed with the present subject matter. FIG. 2 is a top, plan view of range appliance 100. Range appliance 100 may include an insulated cabinet 110. Cabinet 110 may define an upper cooking chamber 120 and a lower cooking chamber 122. Thus, range appliance 100 is generally referred to as a double oven range appliance. As will be understood by those skilled in the art, range appliance 100 is provided by way of example only, and the present subject matter may be used in any suitable appliance, e.g., a single oven range appliance or a standalone cooktop appliance. Thus, the example embodiment shown in FIG. 1 is not intended to limit the present subject matter to any particular cooking chamber configuration or arrangement.

Upper and lower cooking chambers 120 and 122 may be configured for the receipt of one or more food items to be cooked. Oven appliance 100 may include an upper door 124 and a lower door 126 rotatably attached to cabinet 110 in order to permit selective access to upper cooking chamber 120 and lower cooking chamber 122, respectively. Handles 128 may be mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass window panes 130 may provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, may be positioned within upper cooking chamber 120 and lower cooking chamber 122 for heating upper cooking chamber 120 and lower cooking chamber 122.

Oven appliance 100 may also include a cooktop 140. Cooktop 140 may be positioned at or adjacent a top portion of cabinet 110. Thus, cooktop 140 may be positioned above upper and lower cooking chambers 120 and 122. Cooktop 140 may include a top panel 142. By way of example, top panel 142 may be constructed of glass, ceramics, enameled steel, and combinations thereof.

For oven appliance 100, a utensil holding food and/or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 1, burners assemblies 144, 146, 148, 150 may be configured in various sizes so as to provide e.g., for the receipt of cooking utensils (i.e., pots, pans, etc.) of various sizes and configurations and to provide different heat inputs for such cooking utensils. Grates 152 may be supported on a top surface 158 of top panel 142. Oven appliance 100 may also include a griddle burner 160 positioned at a middle portion of top panel 142, as may be seen in FIG. 2. A griddle may be positioned on grates 152 and heated with griddle burner 160.

A user interface panel 154 may be located within convenient reach of a user of the oven appliance 100. For this example embodiment, user interface panel 154 includes knobs 156 that are each associated with one of burner assemblies 144, 146, 148, 150 and griddle burner 160. Knobs 156 may allow the user to activate each burner assembly and determine the amount of heat input provided by each burner assembly 144, 146, 148, 150 and griddle burner 160 to a cooking utensil located thereon. User interface panel 154 may also be provided with one or more graphical display devices that deliver certain information to the user such as e.g., whether a particular burner assembly is activated and/or the rate at which the burner assembly is set.

Although shown with knobs 156, it should be understood that knobs 156 and the configuration of oven appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device designed to provide operational feedback to a user.

For instance, cooking appliance 100 may further include or be in operative communication with a processing device or a controller 166 that may be generally configured to facilitate appliance operation. In this regard, user interface panel 154, knobs 156, and the display may be in communication with controller 166 such that controller 166 may receive control inputs from knobs 156, may display information using the display, and may otherwise regulate operation of cooking appliance 100. For example, signals generated by controller 166 may operate cooking appliance 100, including any or all system components, subsystems, or interconnected devices, in response to the position of knobs 156 and other control commands. User interface panel 154 and other components of cooking appliance 100 may be in communication with controller 166 via, for example, one or more signal lines or shared communication busses. In this manner, Input/Output ("I/O") signals may be routed between controller 166 and various operational components of cooking appliance 100.

Figure 3:
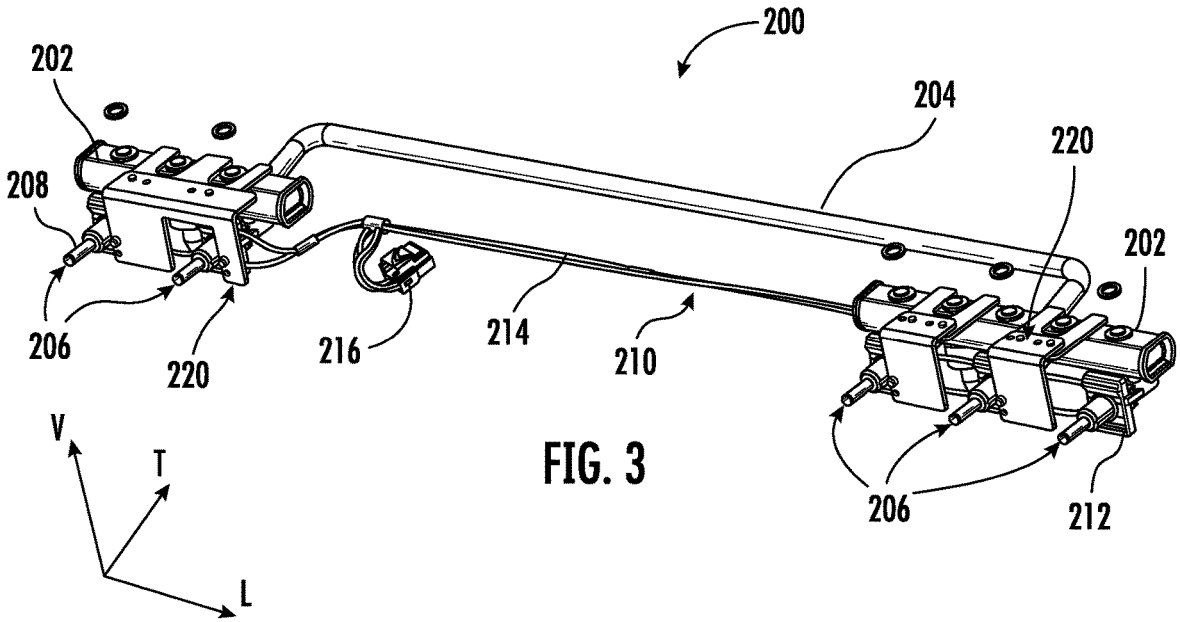
FIG. 3 provides a front perspective view of a gas manifold assembly including bracket assemblies and switch harnesses according to exemplary embodiments of the present disclosure.
Figure 4:
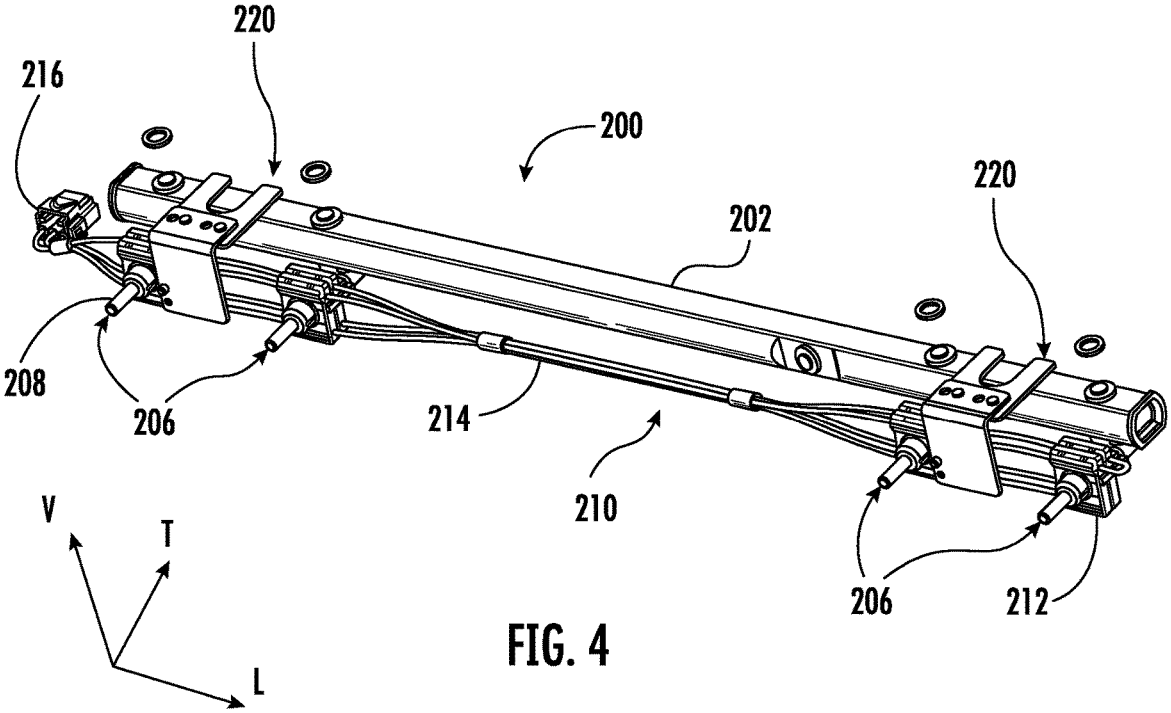
FIG. 4 provides a front perspective view of a gas manifold assembly including bracket assemblies and switch harnesses according to another exemplary embodiment of the present disclosure.

FIG. 3 shows a gas supply assembly 200 for an oven appliance or oven appliance (e.g., oven appliance 100). With reference to FIGS. 3 through 7, gas supply assembly 200 may define a vertical direction V, a lateral direction L, and a transverse direction T. It should be noted that the coordinates defined herein apply to gas assembly 200 and may or may not be equivalent to a vertical direction, lateral direction, and transverse direction defined by oven appliance 100. For instance, gas assembly 200 may be positioned within oven appliance in a tilted manner, such that transverse direction T of gas supply assembly 200 is provided at an acute angle with respect to the transverse direction of oven appliance 100.

In some embodiments, gas supply assembly 200 is a control assembly (e.g., for oven appliance 100). Gas supply assembly 200 may include a manifold 202. For instance, manifold 202 may be a gas manifold through which fuel (e.g., natural gas, propane, etc.) is supplied to one or more burner assemblies (e.g., burner assemblies 144, 146, 148, 150, or griddle burner 160). Gas manifold 202 may be generally tubular, defining a channel through which gas supplied to oven appliance 100 (e.g., from a municipal gas source) may be selectively distributed to at least one of burner assemblies 144, 146, 148, 150 or griddle burner 160.

As shown in FIG. 3, gas manifold 202 may be split into multiple distinct gas manifolds (e.g., a first gas manifold and a second gas manifold) connected by a gas connection tube 204. Accordingly, fuel may be supplied to each of the first and second gas manifolds 202 (e.g., via gas connection tube 204). With brief reference to FIG. 4, however, in alternative embodiments, a single gas manifold 202 is provided (e.g., without a separate gas connection tube).

Figure 7:
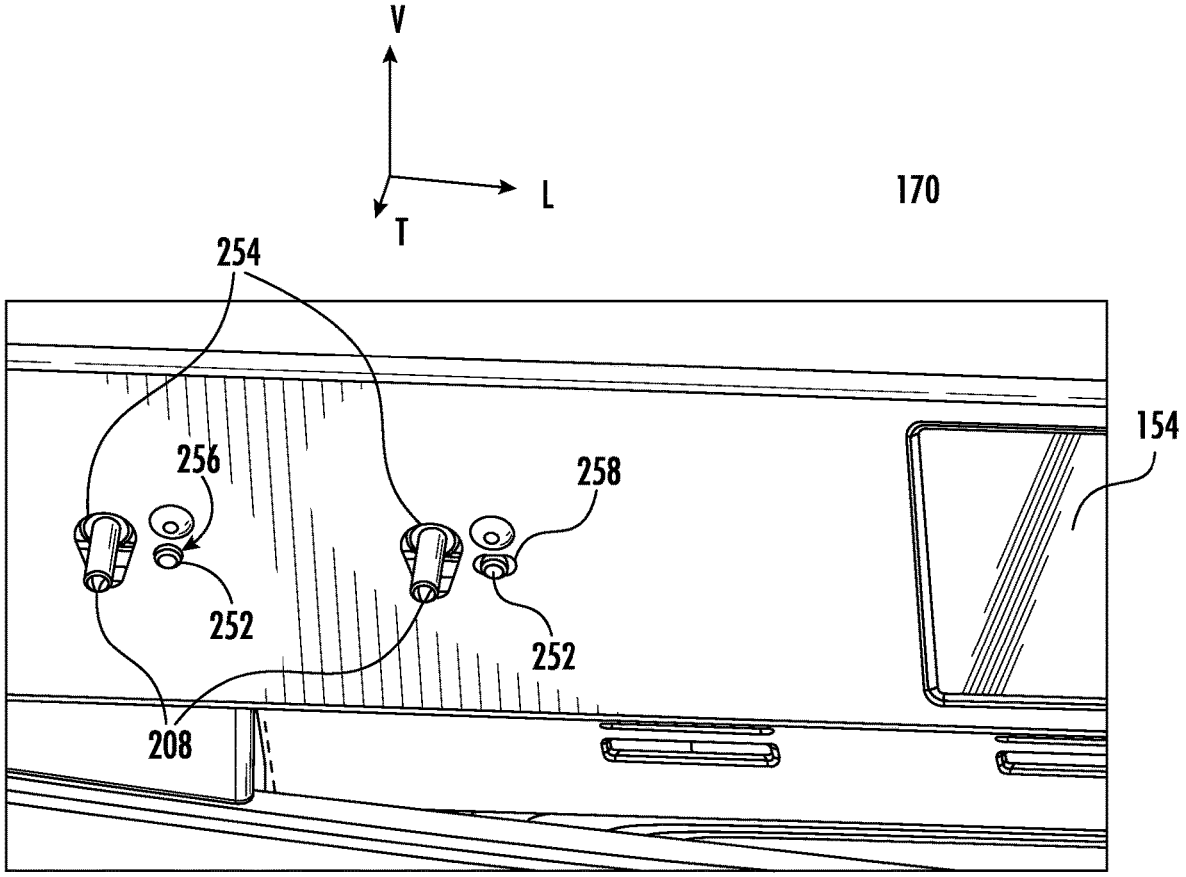
FIG. 7 provides a front close-up view of a control panel of the exemplary oven appliance of FIG. 1 with control knobs removed.

A plurality of valves 206 may be coupled to gas manifold 202 (e.g., first and second gas manifold 202). For instance, each burner assembly 144, 146, 148, 150 and griddle burner 160 may have a dedicated valve 206 through which a supply of fuel (e.g., gas) is controlled or regulated (e.g., via knobs 156). Each valve 206 may be fixed to gas manifold 202 (e.g., via one or more fasteners). In some instances, each valve 206 is fluidly coupled to gas manifold 202 such that manipulation of valve 206 (e.g., via knob 156) restricts or increases the flow or supply of fuel to a respective burner assembly (e.g., by restricting or increasing the size of an opening or aperture between gas manifold 202 and the respective burner assembly). Thus, each valve 206 may include a valve stem or post 208 extending generally away from oven appliance 100 (e.g., through a front panel 170 (FIGS. 2 and 7).

Gas supply assembly 202 may include a switch harness 210. Switch harness 210 may be selectively coupled to each of the plurality of valves 206. In detail, switch harness may include a plurality of switches 212 attached to each other via one or more wires 214. Each respective switch 212 may fit over a respective valve stem 208 (e.g., along the transverse direction T). Switch 212 may be operably connected with valve 206. For one example, each respective switch 212 is snap fit onto each respective valve stem 208. Additionally or alternatively, each respective switch 212 may be operably coupled to a respective knob 156. For instance, switch 212 may send electrical signals related to user inputs at knob 156 to controller 166. According to at least one example, switch 212 detects or senses an input to knob 156 (e.g., a twist, a push, a touch, etc.) and relays the input to controller 166. Switch 212 may therefore be physically connected with knob 157, according to specific embodiments.

Switch harness 210 may include a connector 216. Connector 216 may allow for switch harness 210 to be connected to controller 166. Connector 216 may be an electrical connector (e.g., including one or more conductive prongs) for allowing electrical communication between switch harness 216 and controller 166. For instance, connector 216 may provide an electrical connection between switch harness 210 and controller 166. Additionally or alternatively, connector 216 may provide a physical connection between switch harness 210 and appliance 100. Advantageously, a user may unplug connector 216 to remove switch harness 210 from valve stems 208.

Gas supply assembly 202 may include a bracket assembly 220. Bracket assembly 220 may be selectively couple front panel 170 to manifold 202. Thus, front panel 170 may be removably coupled to manifold 202 via bracket assembly 220 such that front panel 170 may be easily removed from manifold 202 (e.g., for servicing, repair, or replacement). In detail, bracket assembly 220 may include a manifold bracket 222 and a panel bracket 224. Manifold bracket 222 may be fixed to gas manifold 202. For instance, manifold bracket 222 may be welded to gas manifold 202 (e.g., to a top surface thereof). Panel bracket 224 may then be removably coupled to manifold bracket 222. According to some embodiments, panel bracket 224 may be removably coupled directly to manifold 202. For example, panel bracket 224 may be attached directly to manifold 202 via one or more fasteners (e.g., screws, adhesives, hook and loop, magnets, etc.).

Figure 5:
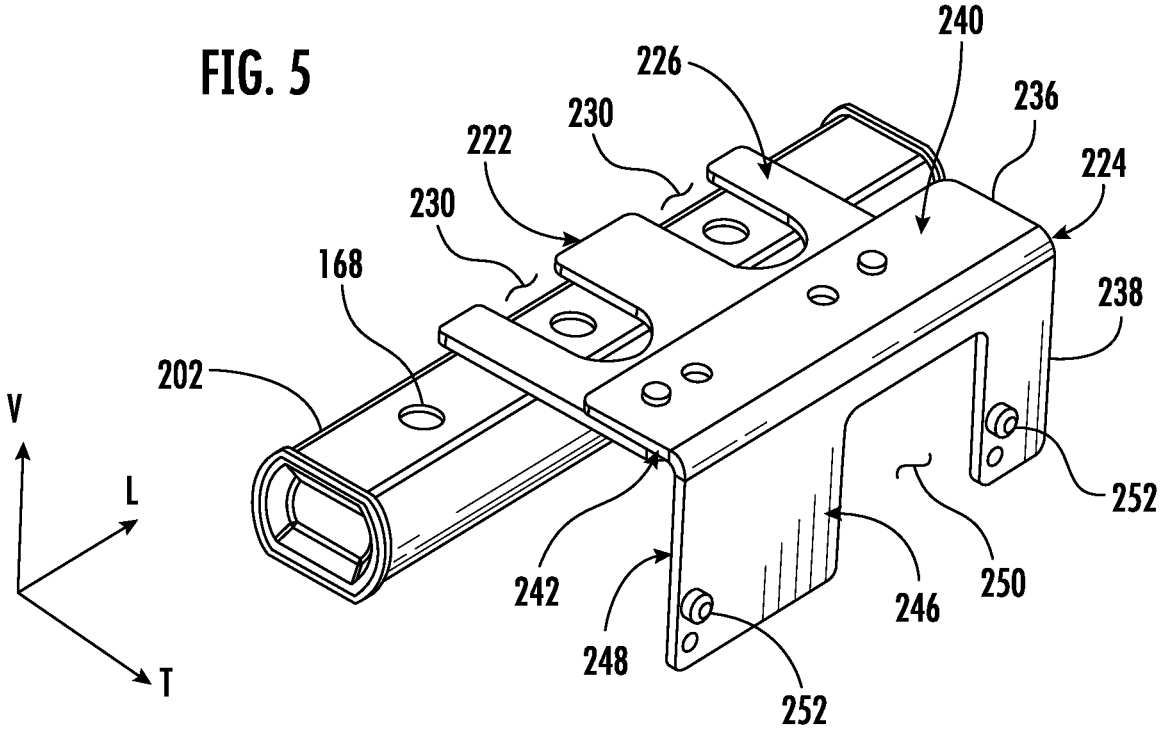
FIG. 5 provides a close-up perspective view of a bracket assembly and gas manifold according to exemplary embodiments of the present disclosure.

As seen in FIG. 5, manifold bracket 222 may include an upper face 226 and a lower face 228 provided opposite upper face 226. For instance, lower face 228 may contact gas manifold 202 (e.g., to be welded or otherwise fixed thereto) while upper face 226 is directed away from the same. Manifold bracket 222 may extend along the transverse direction T from gas manifold 202 (e.g., toward a front of oven appliance 100). Thus, manifold bracket 222 may form a cantilever with respect to gas manifold 202 such that at least portions of each of upper face 226 and lower face 228 are accessible. Additionally or alternatively, manifold bracket 222 may include one or more notches 230 formed into a rear edge thereof. As seen in FIG. 5, notches 230 may be formed around fastener holes 168 within gas manifold 202 to which respective valves 206 are connected. For instance, notches 230 may be formed into the rear edge of manifold bracket 222 along the transverse direction T (e.g., toward a front of oven appliance 100). Notches 230 may form a plurality of tabs on manifold bracket 222, allowing access along the vertical direction V to manifold 202. Thus, manifold bracket 222 may not interfere with placement or operation of any of the valves 206 (e.g., by way of fastener holes 168).

Figure 6:
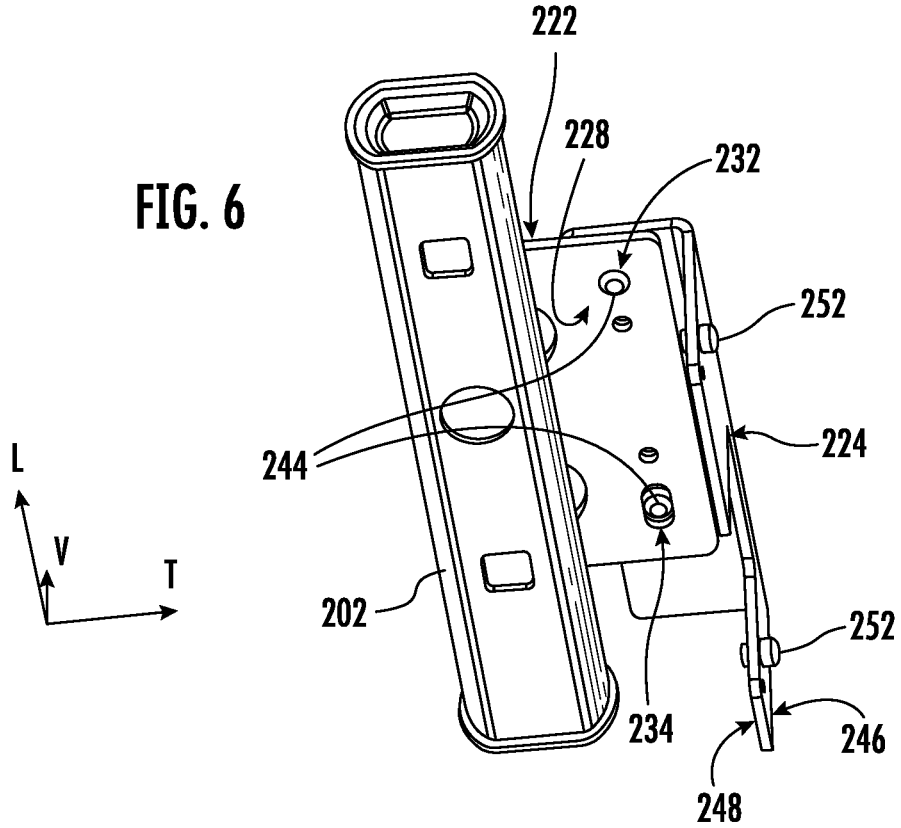
FIG. 6 provides a bottom perspective view of the exemplary bracket assembly of FIG. 5.

Referring briefly to FIG. 6, manifold bracket 222 may include one or more apertures defined therethrough (e.g., along the vertical direction V). For instance, a first aperture 232 and a second aperture 234 may be formed through manifold bracket 222 along the vertical direction V. First aperture 232 and second aperture 234 may be spaced apart from each other along the lateral direction L. According to some embodiments, first aperture 232 has a circular cross-section (e.g., as viewed along the vertical direction V) and second aperture 234 has an ovular cross-section (e.g., as viewed along the vertical direction V). Accordingly, first aperture 232 may be a locating hole (described below) with constraints along the lateral direction L and the transverse direction T while second aperture 234 may be a locating hole with constraints along the transverse direction T. As will be described, first aperture 232 and second aperture 234 may assist in locating panel bracket 224. Additionally or alternatively, manifold bracket 222 may include one or more fastener through holes provided therethrough along the vertical direction V. One or more removable fasteners may then be used to selectively couple panel bracket 224 to manifold bracket 222.

Panel bracket 224 may be selectively coupled to manifold bracket 222. In detail, panel bracket 224 may include a first flange 236 and a second flange 238 extending from first flange 236. Thus, panel bracket 224 may have an "L" shape (e.g., extending along the transverse direction T and the vertical direction V). First flange 236 may be selectively coupled to gas manifold 202. For instance, first flange 236 may be selectively coupled to manifold bracket 222 (e.g., via one or more removable fasteners). First flange 236 may include a top face 240 and a bottom face 242 opposite the top face 240. Bottom face 242 may selectively contact upper face 226 of manifold bracket 222 (e.g., when panel bracket 224 is connected to manifold bracket 222). Thus, second flange 238 may extend from a distal edge of first flange 236 (e.g., along the vertical direction V). According to some embodiments, second flange 238 extends downward along the vertical direction V.

First flange 236 may include a plurality of protrusions 244. In detail, a pair of protrusions may protrude from bottom face 242 of first flange 236 (e.g., along the vertical direction V). The protrusions 244 may be referred to as vertical protrusions, for example. Vertical protrusions 244 may be spaced apart from each other along the lateral direction L. Additionally or alternatively, vertical protrusions 244 may be matched or aligned with the first aperture 232 and the second aperture 234, respectively. Vertical protrusions 244 may be located within first and second apertures 232 and 234 when panel bracket 224 is attached to manifold bracket 222. Advantageously, panel bracket 224 may be accurately and easily located with respect to manifold bracket 222 and, thus, with respect to manifold 202 and each valve 206.

First flange 236 may include one or more fastening holes defined therethrough (e.g., along the vertical direction V). For instance, the fastening holes may be matched or aligned with the fastening holes defined in manifold bracket 222. When panel bracket 224 is located to manifold bracket 222 (e.g., via vertical protrusions 244 and first and second apertures 232 and 234, respectively), one or more fasteners may be used to attach panel bracket 224 to manifold bracket 222 through the fastening holes. For instance, one or more bolts, screws, rivets, clips, adhesives, or the like may be inserted into the fastening holes to secure panel bracket 224 with manifold bracket 222 (e.g., via first flange 236).

Second flange 238 may extend from the distal end of first flange 236 (e.g., distal manifold 202). According to some embodiments (and as shown in FIG. 5), second flange 238 extends downward along the vertical direction V from first flange 236. Second flange 238 may include a front face 246 and a rear face 248 opposite front face 246 along the transverse direction T. For instance, front face 246 may face generally towards the front of oven appliance 100 while rear face may generally face towards, e.g., cooking chamber 120. Front panel 170 may be selectively coupled to second flange 238 (e.g., to front face 246). Additionally or alternatively, second flange 238 may define one or more notches 250 formed therein. As seen in FIG. 6, notch 250 may be formed upward from a bottom edge of second flange 238. Notch 250 may allow for valve 206 (or valve stem 208) to pass through second flange 238 uninhibited (e.g., toward front panel 170).

Second flange 238 may include a plurality of protrusions 252. In detail, the plurality of protrusions 252 may be horizontal protrusions 252. Horizontal protrusions 252 may protrude from front face 246 of second flange 238 (e.g., toward front panel 170). According to some embodiments, a pair of horizontal protrusions 252 are provided on front face 246. Horizontal protrusions 252 may be similar to vertical protrusions 244 on first flange 236. For instance, horizontal protrusions 252 may be spaced apart from each other about the lateral direction L. Horizontal protrusions 252 may be matched or aligned with a pair of locator holes (defined below) provided through front panel 170. Thus, front panel 170 may be aligned with respect to panel bracket 224 (and, coincidentally, manifold 202 and valves 206) when front panel 170 (including user interface panel 154) is attached to oven appliance 100. Second flange 238 may include one or more fastener holes defined therethrough (e.g., along the transverse direction T). One or more fasteners may be provided through the fastener holes to selectively fasten front panel 170 (and control panel 154) to panel bracket 224.

Referring now to FIG. 7, a close-up front perspective view of front panel 170 with knobs 156 removed is shown. As can be seen in FIG. 7, front panel 170 may define a plurality of valve holes 254. Valve holes 254 may be defined through front panel 170 along the transverse direction T (e.g., with respect to control assembly 200). Valve holes 254 may allow valve stems 208 of valves 206 to pass through front panel 170 (e.g., to be accessed and manipulated by a user via knobs 156). Thus, a corresponding number of valve holes 254 may be provided in front panel 170 so as to accommodate the number of valves 206 (e.g., for the number of burner assemblies) within oven appliance 100.

Front panel 170 may include a first locator hole 256 and a second locator hole 258. First and second locator holes 256 and 258 may be defined through front panel 170 along the transverse direction T. First locator hole 256 may be positioned adjacent to a first valve hole 254 along the lateral direction L and second locator hole 258 may be positioned adjacent to a second valve hole 254 along the lateral direction L. Thus, first and second locator holes 256 and 258 may be spaced apart from each other along the lateral direction L.

First locator hole 256 may be aligned or matched with a horizontal protrusion 252 protruding from front face 246 of second flange 224. In detail, first locator hole 256 may be generally circular in cross section (e.g., as viewed along the transverse direction T. For instance, as front panel 170 is positioned onto appliance 100, first locator hole 256 is aligned with one of the horizontal protrusions 252. Horizontal protrusion 252 may thus penetrate front panel 170 via first locator hole 256 (e.g., along the transverse direction T). Accordingly, first locator hole 256 may restrain horizontal protrusion 252 along the vertical direction V and along the lateral direction L.

Second locator hole 258 may be aligned or matched with a horizontal protrusion 252 protruding from front face 246 of second flange 224. In detail, second locator hole 258 may be generally ovular in cross section (e.g., as viewed along the transverse direction T. Accordingly, second locator hole 258 may restrain horizontal protrusion 252 along the Vertical direction V. Collectively, first and second locator holes 256 and 258 may ensure front panel 170 is properly aligned with respect to valves 206 and valve stems 208, thus ensuring proper fit and finish of control panel 154 and control knobs 156.

Front panel 170 may include one or more fastener holes. The fastener holes may be aligned with the fastener holes of second flange 238. Accordingly, front panel 170 may be coupled to panel bracket 224 via one or more fasteners. According to embodiments described herein, front panel 170 may be easily removed from oven appliance 100 through panel bracket 224. Panel bracket 224 may then be easily removed from manifold 202 (e.g., via manifold bracket 222). Once panel bracket 224 is removed, switch harness 210 may be removed from valves 206 for service, repair, or replacement. Advantageously, switch harness 210 is able to be removed without any manipulation of a gas line, making for easy repair or replacement. Additionally or alternatively, placement and replacement of front panel 170 may be ensured as accurate via the locating features provided on bracket assembly 220.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance defining a vertical direction, a lateral direction, and a transverse direction, the oven appliance comprising:

a cabinet defining a cooking chamber;

a control panel provided on the cabinet;

a fuel supply line provided at the cabinet;

a manifold bracket attached to the fuel supply line, wherein the manifold bracket comprises an aperture defined therethrough along the vertical direction; and a panel bracket, wherein the manifold bracket is provided between the panel bracket and the fuel supply line such that the panel bracket is selectively coupled to the fuel supply line through the manifold bracket via one or more removable fasteners, the panel bracket comprising:

a first flange selectively coupled to the fuel supply line;

a second flange extending from the first flange at a predetermined angle, the second flange being selectively coupled to the control panel;

a vertical protrusion protruding from the first flange along the vertical direction toward the fuel supply line to locate the panel bracket with respect to the fuel supply line, wherein the aperture is aligned with the vertical protrusion along the vertical direction; and a horizontal protrusion protruding from the second flange away from the fuel supply line to locate the panel bracket with respect to the control panel.

2. The oven appliance of claim 1, wherein the manifold bracket is welded to a top face of the fuel supply line.

3. The oven appliance of claim 1, wherein the vertical protrusion is a first vertical protrusion and the aperture is a first aperture, and wherein the panel bracket further comprises a second vertical protrusion spaced apart from the first vertical protrusion, and the manifold bracket further comprises a second aperture spaced apart from the first aperture, the second vertical protrusion being accepted within the second aperture.

4. The oven appliance of claim 1, wherein the second flange extends downward along the vertical direction from the first flange, the second flange being positioned in front of the fuel supply line along the transverse direction.

5. The oven appliance of claim 1, wherein the horizontal protrusion is a first horizontal protrusion and wherein the panel bracket further comprises:

a second horizontal protrusion spaced apart from the first horizontal protrusion along the lateral direction.

6. The oven appliance of claim 5, wherein each of the first horizontal protrusion and second horizontal protrusion protrudes away from the fuel supply line.

7. The oven appliance of claim 6, wherein the control panel comprises:

a first locator hole defined therethrough along the transverse direction, the first locator hole being aligned with the first horizontal protrusion; and a second locator hole defined therethrough along the transverse direction, the second locator hole being aligned with the second horizontal protrusion.

8. The oven appliance of claim 7, wherein the first locator hole has a circular cross-section and the second locator hole has an ovular cross-section.

9. A control assembly for an oven appliance, the oven appliance defining a vertical direction, a lateral direction, and a transverse direction and comprising a control panel and a fuel supply line, the control assembly comprising:

a panel bracket, the panel bracket comprising:

a first flange;

a second flange extending from the first flange at a predetermined angle;

a vertical protrusion protruding from the first flange along the vertical direction toward the fuel supply line to locate the panel bracket with respect to the fuel supply line; and a horizontal protrusion protruding from the second flange away from the fuel supply line to locate the panel bracket with respect to the control panel; and a manifold bracket, the manifold bracket being fixed to the fuel supply line, wherein the panel bracket is removably coupled to the manifold bracket, wherein the panel bracket is coupled to the manifold bracket via one or more removable fasteners, and wherein the manifold bracket comprises an aperture defined therethrough along the vertical direction, the aperture being aligned with the vertical protrusion along the vertical direction.

10. The control assembly of claim 9, wherein the manifold bracket is welded to a top face of the fuel supply line.

11. The control assembly of claim 9, wherein the vertical protrusion is a first vertical protrusion and the aperture is a first aperture, and wherein the panel bracket further comprises a second vertical protrusion spaced apart from the first vertical protrusion, and the manifold bracket further comprises a second aperture spaced apart from the first aperture, the second vertical protrusion being accepted within the second aperture.

12. The control assembly of claim 9, wherein the second flange extends downward along the vertical direction from the first flange, the second flange being positioned in front of the fuel supply line along the transverse direction.

13. The control assembly of claim 9, wherein the horizontal protrusion is a first horizontal protrusion and wherein the panel bracket further comprises:

a second horizontal protrusion spaced apart from the first horizontal protrusion along the lateral direction.

14. The control assembly of claim 13, wherein each of the first horizontal protrusion and second horizontal protrusion protrudes away from the fuel supply line.

15. The control assembly of claim 14, wherein the control panel comprises:

a first locator hole defined therethrough along the transverse direction, the first locator hole being aligned with the first horizontal protrusion; and a second locator hole defined therethrough along the transverse direction, the second locator hole being aligned with the second horizontal protrusion.

16. The control assembly of claim 15, wherein the first locator hole has a circular cross-section and the second locator hole has an ovular cross-section.

* * * * *